US009056322B1

(12) United States Patent
Williams

(10) Patent No.: US 9,056,322 B1
(45) Date of Patent: Jun. 16, 2015

(54) FLUID JET APPARATUS

(71) Applicant: Jack Williams, Tucson, AZ (US)

(72) Inventor: Jack Williams, Tucson, AZ (US)

( * ) Notice: Subject to any disclaimer, the term of this patent is extended or adjusted under 35 U.S.C. 154(b) by 0 days.

(21) Appl. No.: 14/227,660

(22) Filed: Mar. 27, 2014

(51) Int. Cl.

| | |
|---|---|
| ***B05B 7/08*** | (2006.01) |
| ***B05B 7/04*** | (2006.01) |
| ***B05B 1/20*** | (2006.01) |
| ***B05B 7/06*** | (2006.01) |
| ***E03C 1/084*** | (2006.01) |
| ***F23D 14/04*** | (2006.01) |
| ***A61H 33/02*** | (2006.01) |

(52) U.S. Cl.

CPC ..... *B05B 7/0416* (2013.01); *B05B 1/20* (2013.01); *B05B 7/04* (2013.01); *B05B 7/06* (2013.01); *E03C 1/084* (2013.01); *F23D 14/04* (2013.01); *A61H 33/025* (2013.01); *A61H 33/02* (2013.01); *A61H 33/027* (2013.01)

(58) Field of Classification Search

CPC ..... B05B 7/04; B05B 7/06; B05B 1/20; B05B 7/0416; F23C 3/04; E03C 1/084; F23D 14/04; A61H 33/02; A61H 33/025; A61H 33/027; F25C 3/04

USPC ..... 239/14.2, 419, 419.5, 423, 424, 425.5, 239/566; 4/541.4, 541.5, 541.6

See application file for complete search history.

(56) References Cited

U.S. PATENT DOCUMENTS

| | | | | |
|---|---|---|---|---|
| 3,494,559 | A * | 2/1970 | Skinner | 239/14.2 |
| 4,142,337 | A | 3/1979 | Holcomb | |
| 4,170,044 | A | 10/1979 | Steimle | |
| 4,262,371 | A * | 4/1981 | Berry et al. | 4/541.6 |
| 4,340,982 | A | 7/1982 | Hart et al. | |
| 4,368,550 | A | 1/1983 | Stevens | |
| 4,420,846 | A | 12/1983 | Bonner | |
| 4,502,168 | A * | 3/1985 | Jaworski | 4/541.6 |
| 4,837,870 | A | 6/1989 | Wiley | |
| 5,083,329 | A | 1/1992 | Murakami | |
| 5,156,642 | A | 10/1992 | Lopez | |
| 5,418,984 | A | 5/1995 | Livingston, Jr. | |
| 5,754,989 | A | 5/1998 | Ludlow | |
| 5,809,648 | A | 9/1998 | Kurth et al. | |
| 5,896,597 | A | 4/1999 | Kurth et al. | |
| 5,987,663 | A | 11/1999 | Ludlow et al. | |
| 6,092,246 | A | 7/2000 | Ludlow | |
| 6,131,212 | A | 10/2000 | Lang | |
| 6,233,754 | B1 | 5/2001 | Ajima | |
| 6,237,897 | B1 | 5/2001 | Marina | |
| 6,256,805 | B1 | 7/2001 | Ludlow et al. | |
| 6,263,522 | B1 | 7/2001 | Dongo et al. | |
| 6,804,841 | B1 | 10/2004 | Williams | |
| 6,874,711 | B2 | 4/2005 | Dieterle et al. | |
| 6,935,576 | B2 * | 8/2005 | Hara | 239/398 |
| 7,493,665 | B2 | 2/2009 | Williams | |
| 2003/0146302 | A1 | 8/2003 | Dieterle et al. | |

* cited by examiner

*Primary Examiner* — Steven J Ganey

(74) *Attorney, Agent, or Firm* — Quarles & Brady LLP; Gavin J. Milczarek-Desai

(57) ABSTRACT

A self-contained fluid jet assembly that includes a first chamber having a fluid inlet and a second chamber having an air inlet and at least one fluid outlet. An opening is present between the first chamber and said second chamber and is surrounded by a nozzle in the second chamber. The nozzle terminates short of a fluid outlet such that an air gap is defined between the nozzle and outlet, thereby creating an improved jet action.

9 Claims, 2 Drawing Sheets

FLUID JET APPARATUS

BACKGROUND OF THE INVENTION

1. Field of the Invention

This invention relates generally to fluid jet apparatus and more particularly to apparatuses that feature one or more fluid jets for use in applications such as pools, spas, aquariums, and chemical dispensing.

2. Description of the Related Art

In addition to pool and spa use, fluid jet apparatus and systems have many applications, such as firefighting, surface cleaning, hydroexcavation, demolition, machining, and mining.

In a pool, spa, or bath setting, massage systems of various configurations have been provided to inject fluids, such as air or water. One known massage system uses water jets equipped with venturi devices whereby air is sucked by the flow of water directed to the user. In such a massage system, the water jet pressure must be maintained relatively high to induce a suitable sucking effect on the air in the venturi device. Therefore, the presence of air bubbles is limited by the pressure of the fluid. Alternatively, multiple air inlets or individual air and fluid chambers for each jet are needed to provide a sufficient jet effect at lower fluid pressures. This leads to relatively complicated and expensive designs for jet assemblies.

Moreover, existing fluid jet apparatus have certain design features that present safety and maintenance concerns. High pressure fluids present safety risks, particularly when operated near people and property. For example, a high pressure device that utilizes hoses and is positioned near an operator's head presents a risk that the coupling may fail during operation, after which the high pressure hose can whip about until the pressure is terminated.

Further, the use of high pressure and of different fluids, such as those containing a particulate, presents challenges in maintaining the system components. For example, seals, hoses and valves tend to break down quickly if under constant high pressure and/or abrasive material flows through the components.

SUMMARY OF THE INVENTION

The invention relates in general to fluid jet apparatus that includes a first chamber having a fluid (e.g., water) inlet, a second chamber having an air inlet and a fluid outlet, and an interface between the first and second chambers through which the fluid flows. Preferably, the fluid jet apparatus does not utilize hoses between the fluid supply inlet and the fluid outlet, making it especially simple to install and resistant to leakage over time. Accordingly, fluid (and air) flow hoselessly from the inlet to one or more outlets such that a fluid jet effect is achieved.

Thus, in one preferred aspect, the embodiments herein provide a self-contained fluid jet assembly that includes a first chamber having a fluid inlet and a second chamber having an air inlet and at least one fluid outlet, wherein an opening is present between said first chamber and said second chamber. The opening is contiguous with and surrounded by a nozzle in the second chamber. The nozzle terminates short of, i.e., is not contiguous with, the fluid outlet such that an air gap is defined between the nozzle and outlet.

In another preferred aspect, the embodiments herein provide a fluid jet assembly in which the first (fluid) chamber defines an L-shaped member and the second (air) chamber defines an L-shaped member, with the first and second chambers being joined along a common panel such that a rectangular body is formed.

Various other purposes and advantages of the invention will become clear from its description in the specification that follows. Therefore, to the accomplishment of the objectives described above, this invention includes the features hereinafter fully described in the detailed description of the preferred embodiments, and particularly pointed out in the claims. However, such description discloses only some of the various ways in which the invention may be practiced.

DETAILED DESCRIPTION OF THE PREFERRED EMBODIMENTS

Embodiments described herein relate to an improved fluid jet apparatus configured such that a nozzle, i.e., a structure with a tapered end through which fluid flows, conveys a fluid from a first chamber to a second chamber containing air such that fluid flows through the nozzle and an air gap before exiting a fluid outlet in the air-containing chamber. Surprisingly, a strong jet action can be achieved with relatively low fluid pressure and without the need for hoses, fittings, or a continuous conveying structure from the fluid supply. Moreover, having L-shaped chambers joined along a common panel to form a rectangular has been found to enhance the jet effect by allowing for smoother fluid flow and air flow by providing a straighter path and reducing surface friction. The "L" shape has also been found to provide better structural integrity under pressure.

Figure 1:
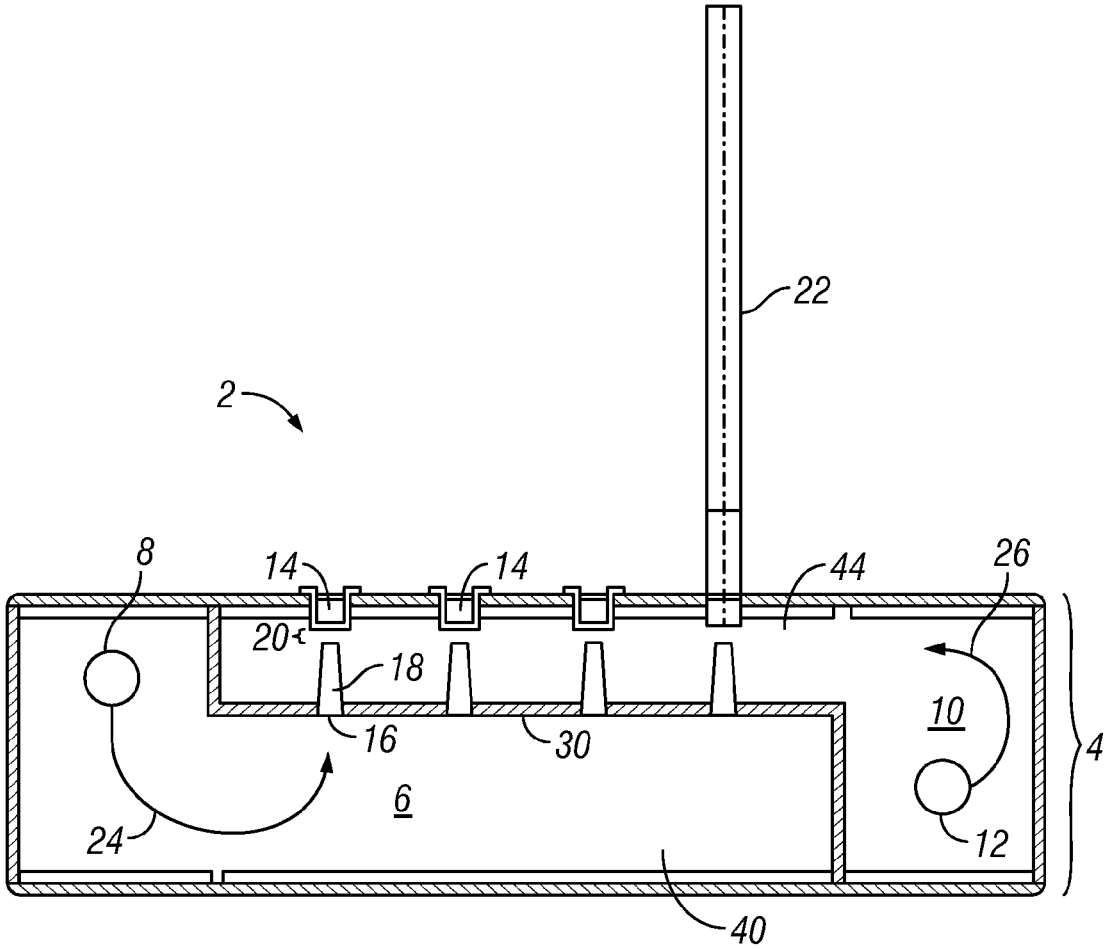
FIG. 1 depicts a top cross-sectional view of an embodiment of the improved fluid jet apparatus. While multiple jets are shown, a single jet is used in many applications and created by simply having a single nozzle/outlet and typically smaller dimensions for the remaining structure.
Figure 2:
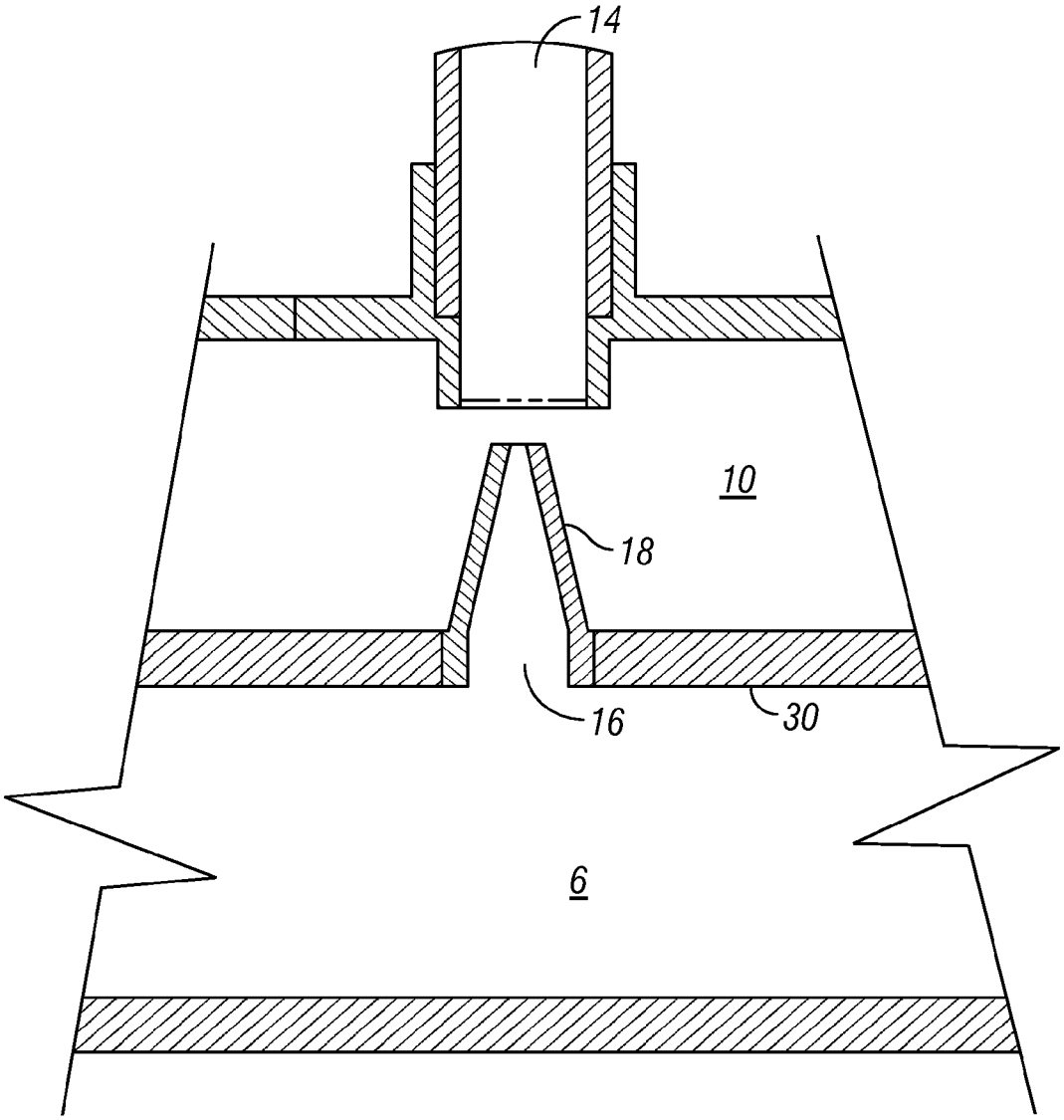
FIG. 2 shows an enlarged view of a single jet of FIG. 1 at circle 2.

Turning to the figures, in which like numerals designate like elements, FIG. 1 depicts an improved fluid jet apparatus 2. The apparatus includes a self-contained fluid jet assembly 4 that includes a first chamber 6 having a fluid inlet 8 and a second chamber 10 having an air inlet 12 and at least one fluid outlet 14. An opening 16 is present between chamber 6 and chamber 10, with the opening being surrounded by a nozzle 18 in chamber 10. The nozzle 18 terminates short of fluid outlet 14 such that an air gap 20 is defined between the nozzle and outlet. Optional outlet extension may be used in certain applications, such as an in-ground spa.

As can be readily seen in FIG. 1, fluid 24 flows hoselessly from the fluid inlet 8 to and out of the fluid outlet 14 after mixing with air 26 in the air gap 20. Preferably, the air gap 20 between the nozzle 18 and fluid outlet 14 is about one-quarter inch. Such spacing has been found to produce a strong jet effect even at relatively low fluid pressures.

Also preferably, the nozzle 18 tappers to a diameter that is between about 1%-33% less than the fluid outlet diameter and especially that is about 15% less than the fluid outlet diameter. However, the only requirement of the nozzle is that the front interior opening (exit) of the nozzle must be smaller than the rear opening (entrance). Moreover, the opening 16 preferably is disposed through common panel 30 in coaxial alignment with the outlet 14.

As depicted in FIG. 1, the first chamber 6 preferably defines an L-shaped member 40 and second chamber 10 preferably defines a second L-shaped member 44, with the first and second chambers being joined along the common panel 30 such that a rectangular body is formed. As mentioned above, such a construction has been found to aid in reducing surface friction for the fluid and air, and, therefore, aids the flow of fluid through the outlet.

In essence, a venturi effect is created at the interface of the air and fluid chambers as the fluid flows through the nozzle. Given the simplicity of design and ease of installation, it will be readily appreciated that the embodiments described herein can be placed on walls, floors, or seats of the interior of an in-ground spa, a bath, or a pool. In other applications, a fluid jet apparatus as described herein can be used as a part of a protein skimmer in an aquarium.

Preferably, the chamber structures of the invention are constructed from durable polyvinyl or acrylic materials. However, any suitably durable and corrosion-resistant material may be utilized. All of these features make the fluid jet apparatus described herein ideal for in-ground spa or pool installation, use as a part of a protein skimmer assembly in an aquarium, and for other fluid jet applications, such as cleaning solvent or fire retardant dispensers and the like.

Various changes in the details and components that have been described may be made by those skilled in the art within the principles and scope of the invention herein described in the specification and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

What is claimed is:

1. A fluid jet apparatus, comprising:

a self-contained fluid jet assembly that includes a first chamber having a fluid inlet and a second chamber having an air inlet and at least one fluid outlet, wherein an opening is present between said first chamber and said second chamber, said opening is surrounded by a nozzle in said second chamber, and said nozzle terminates short of said at least one fluid outlet such that an air gap is defined between the nozzle and outlet, wherein said first chamber defines an L-shaped member and said second chamber defines an L-shaped member, with said first and second chambers being joined along a common panel such that a rectangular body is formed.

2. The apparatus of claim 1, wherein fluid flows hoselessly from said fluid inlet to and out of said fluid outlet.

3. The apparatus of claim 1, wherein said air gap between said nozzle and said fluid outlet is about one-quarter inch.

4. The apparatus of claim 1, wherein said opening is disposed through said common panel in coaxial alignment with said fluid outlet.

5. The apparatus of claim 1, wherein said nozzle tapers to a diameter that is between about 10%-33% less than the fluid outlet diameter.

6. The apparatus of claim 5, wherein said nozzle tapers to a diameter that is about 15% less than the fluid outlet diameter.

7. The apparatus of claim 1, wherein said nozzle tapers to a diameter that is between about 1%-33% less than the fluid outlet diameter.

8. The apparatus of claim 7, wherein fluid flows hoselessly from said fluid inlet to and out of said fluid outlet.

9. The apparatus of claim 1, wherein fluid flows hoselessly from said fluid inlet to and out of said fluid outlet.

* * * * *